US010329889B2

(12) United States Patent
Jani

(10) Patent No.: US 10,329,889 B2
(45) Date of Patent: Jun. 25, 2019

(54) FRACKING TOOL FURTHER HAVING A DUMP PORT FOR SAND FLUSHING, AND METHOD OF FRACKING A FORMATION USING SUCH TOOL

(71) Applicant: PINNACLE OIL TOOLS INC., Red Deer (CA)

(72) Inventor: William Jani, Calgary (CA)

(73) Assignee: PINNACLE OIL TOOLS INC., Red Deer, Alberta (CA)

( * ) Notice: Subject to any disclaimer, the term of this patent is extended or adjusted under 35 U.S.C. 154(b) by 147 days.

(21) Appl. No.: 15/456,428

(22) Filed: Mar. 10, 2017

(65) Prior Publication Data

US 2017/0183931 A1 Jun. 29, 2017

Related U.S. Application Data

(63) Continuation-in-part of application No. 14/637,114, filed on Mar. 3, 2015, now Pat. No. 9,719,334.

(51) Int. Cl.

| | |
|---|---|
| ***E21B 43/26*** | (2006.01) |
| ***E21B 33/124*** | (2006.01) |
| ***E21B 23/00*** | (2006.01) |
| ***E21B 33/129*** | (2006.01) |
| ***E21B 34/10*** | (2006.01) |
| ***E21B 43/114*** | (2006.01) |
| *E21B 34/00* | (2006.01) |

(52) U.S. Cl.
CPC ..... *E21B 43/26* (2013.01); *E21B 23/006* (2013.01); *E21B 33/124* (2013.01); *E21B 33/129* (2013.01); *E21B 34/10* (2013.01); *E21B 43/114* (2013.01); *E21B 2034/007* (2013.01)

(58) Field of Classification Search
CPC ..... E21B 2034/007; E21B 23/006; E21B 33/124; E21B 33/129; E21B 34/10; E21B 43/114; E21B 43/26
See application file for complete search history.

(56) References Cited

U.S. PATENT DOCUMENTS

| | | | | |
|---|---|---|---|---|
| 3,120,272 A | | 2/1964 | Cochran | |
| 3,414,059 A | * | 12/1968 | Nutter | E21B 23/00 166/128 |
| 2003/0111236 A1 | * | 6/2003 | Serafin | E21B 23/06 166/387 |
| 2011/0162846 A1 | | 7/2011 | Palidwar | |

(Continued)

*Primary Examiner* — Caroline N Butcher
(74) *Attorney, Agent, or Firm* — D. Doak Horne

(57) ABSTRACT

A tool for fracking a formation at spaced intervals, which has an actuatable "dump" port to flush an annular space surrounding the tool when in a wellbore to thereby flush sand and reduce tendency for "sanding-in" of the tool in the wellbore. An uphole and downhole packer is provided, intermediate of which is a frac port. The dump port is located uphole thereof. Locking jaw members and a 'j' slot subassembly downhole of both the dump port and frac port are together used to set and unset the tool in the wellbore. A slidable sleeve opens and closes the dump port, which sleeve may be actuated by movement of the tool in the wellbore or alternatively by an actuating tool inserted in the bore of the tool. A method of carrying out fracking of the formation and flushing of the tool after each fracking operation is further disclosed.

12 Claims, 8 Drawing Sheets

(56) References Cited

U.S. PATENT DOCUMENTS

| | | | | |
|---|---|---|---|---|
| 2012/0090847 | A1* | 4/2012 | Getzlaf | E21B 23/02 166/305.1 |
| 2013/0248192 | A1 | 9/2013 | Cook | |
| 2015/0013982 | A1 | 1/2015 | Getzlaf | |
| 2015/0226028 | A1 | 8/2015 | Ringgenberg | |
| 2015/0376968 | A1* | 12/2015 | Flores | E21B 33/124 166/279 |
| 2015/0376975 | A1 | 12/2015 | Flores | |

* cited by examiner running
pulling
set
'P'
10
16
32
50
60
62
64
65
78
80
90
94
95
97
99
200
202
204

FRACKING TOOL FURTHER HAVING A DUMP PORT FOR SAND FLUSHING, AND METHOD OF FRACKING A FORMATION USING SUCH TOOL

CROSS-REFERENCE

This application is a continuation-in-part of U.S. application Ser. No. 14/637,114 (US Pub. Nol. 2016/0258258) filed Mar. 3, 2015 entitled "Method and Tool for Perforating a Wellbore Casing in a Formation using a Sand Jet, and using such Tool to further Frac the Formation".

FIELD OF THE INVENTION

The present invention relates to a downhole tool for fracking an underground hydrocarbon formation. More specifically, the present invention relates to a tool which has a dump port in place of a perforating jet which tool allows successive flushing of an annular region surrounding the tool after each successive fracing operation carried out by the tool, to thereby avoid sanding in of the tool within the wellbore after each fracking operation. A method of fracking employing such tool is further taught.

BACKGROUND OF THE INVENTION AND DESCRIPTION OF THE PRIOR ART

The below provided background information and description of prior publications is provided for the purpose of making known information believed by the applicant to be of possible relevance to the present invention. No admission is necessarily intended, nor should be construed, that any of the below publications and information provided constitutes prior art against the present invention.

In order to prepare a cased wellbore drilled in a hydrocarbon formation for production, such cased wellbore first needs to be perforated along portions of its length in order for hydrocarbons to flow into such wellbore for pumping to surface.

Prior art apparati and methods for creating perforations in the wellbore casing have typically comprised placing a string of explosive charges, namely shaped charges adapted to explode radially outwardly, within and along a length of the wellbore, and igniting such charges and thereafter withdrawing the perforating string from the wellbore.

Other methods and apparati for creating perforations along a wellbore have involved insertion of a tool having one or more nozzles, adapted to direct radially outwardly therefrom an abrasive fluid under high pressure. Such abrasive high pressure fluid impacts the wellbore casing and due to its abrasive nature, cuts a hole or holes in the wellbore casing. Such tool is moved along the wellbore casing to create additional perforations in such wellbore along a desired length thereof.

Typically, after a wellbore has been perforated, as a means to increase the rate and volume of production from the formation prior to commencing production therefrom a fracking fluid (typically containing proppants, acids, diluents, and/or other flow-stimulating additives) is injected under high pressure into the wellbore in a fracking operation. Typically only portions of a wellbore are "fracked" at a time, requiring a zone of a wellbore that is to be fracked to be isolated from other regions of the wellbore, typically by rubberized packer elements which are actuated by hydraulic pressure.

In such fracking operation, when a particular one or number of perforations along a wellbore are isolated by packers, a high pressure fluid is flowed into the wellbore and thus into the formation in the region of the perforation(s). Such high pressure fluid creates fissures within the formation. The created fissures (typically lines of fracture within the formation) generally emanate radially outwardly from the wellbore and thereby create flow channels in the formation which lead to the wellbore, thereby assisting hydrocarbons to subsequently flow into and be collected by the wellbore.

Unsatisfactorily however, no tool exists that is able to both perforate using abrasive jets, as well as carry out fracking operations without having to use separate tools and trip the tool out, in an effective and efficient manner.

U.S. Pat. No. 4,781,250 to McCormick et al., entitled "Pressure Actuated Cleaning Tool" teaches a downhole tool for cleaning tubing, casing and flow lines with pressurized cleaning fluid pumped through coiled tubing. The cleaning tool is rotated by a "J"-slot indexing tool, which activated by fluid pressure changes and a spring, to effectively rotate the tool 360°. McCormick et al does not, however, disclose any apparati or method on the same tool for further being able to carrying out fracking of the formation via the perforations created by such same tool.

U.S. Pat. No. 7,963,332 to Dotson, entitled "Apparatus and Method for Abrasive Jet Perforating", teaches a device using an abrasive jet for perforating, with a mechanical locating collar. Such patent however does not teach any sliding sleeve to open and close the perforating jet, nor does it teach use of such perforator jet, in combination with a packers, a bypass, a "j" slot used to set and release a setting tool, and frac ports, all incorporated into and for use by the same tool to permit both perforating and fracking using the same tool.

Likewise, and to similar effect, U.S. Pat. No. 8,757,262 similarly to Dotson, entitled "Apparatus and Method for Abrasive Jet Perforating and Cutting of Tubular Members", teaches an abrasive jet perforating tool, coupled rotatably to a tubing string, and a horizontal indexing tool coupled thereto. An extension tool with a protective sleeve is used to protect the apparatus. Again, however, such patent fails to disclose any apparati or method on the same tool for further being able to carrying out fracking of the formation via the perforations created by such same tool.

U.S. Pat. No. 5,765,756 by Jordan et al., entitled "Abrasive Slurry Jetting Tool and Method" teaches an abrasive jet perforating tool with telescoping jet nozzles. The jetting nozzles are operated perpendicularly to the longitudinal axis of the tool body, although the nozzle assemblies can pivot back into the tool body for retrieval back up the wellbore. Jordan et al similarly fails to disclose a single tool with further components which allow not only perforation but also setting of the tool to frac as well as perforate, or a method by which fracking and perforation using an abrasive jet may be accomplished by a single tool.

Accordingly, a clear need exists in the wellbore completion industry for a tool which uses abrasive jetting to create perforations in wellbore casings, and which may further accomplish fracking of the formation using the same tool, to thereby save time and speed completion of wellbores in preparation for hydrocarbon production therefrom.

A clear and serious need further exists in fracking operations to provide a tool which is not prone to becoming "sanded-in" within the wellbore. In this regard, a "sanded-in" fracking tool at the end of a frack string cannot be removed after fracking to thereby allow oil production to commence from the completed well.

Specifically, it has been found that fracking tools at the end of a fracking tubing string and which are typically lowered to the bottom of a wellbore and thereafter moved upwardly to successively frac the formation along the wellbore during such upward movement, may frequently, due to the introduction of fracking sand within a fracking mixture at each fracking interval to thereby "prop" open the fractures created in the wellbore to allow better flow of oil, cause the fracking tool becoming "sanded in" within the wellbore and the frac string thus be unable to be removed from the wellbore.

This is a very serious and potential problem if it occurs, as no production of oil can thereafter be achieved. The fracking string will then need to be pulled up with such force that it will break, and a milling tool re-inserted down the wellbore to mill out any remaining sand-entrapped components of the frack string remaining in the well, to thereby clear the well for production.

Obviously, 'sanding-in' of fracking tools is a very serious problem as it results in significant lost production time, to say nothing of the time resulting lost time and expense of having to mill out damaged and "sanded-in" frac string components.

A very serious need thus exists for a fracking tool which is able to reliably or better prevent "sanding in" of the tool after one or more successive fracking operations along a wellbore.

SUMMARY OF THE INVENTION

It is thus an object of one aspect of the invention to provide a frac tool which is adapted to successively frac a wellbore along its length, but is further provided with means to avoid the fracking tool becoming sanded-in after a particular fracking operation along the wellbore.

Accordingly, in one particular aspect the present invention provides a downhole tool which not only successively fracs at spaced intervals along a perforated wellbore, but is further provided with what is figuratively referred to herein as a "dump valve" which may be opened, if desired or considered necessary, to allow flushing of an annular space surrounding the frac tool with a flushing fluid after every successive frac operation carried out, so as to reduce the risk of the fracking tool, and thus the frac string, from becoming "sanded-in".

More particularly, the present invention in a third embodiment thereof comprises a downhole tool for injecting a fluid into a hydrocarbon formations at various spaced intervals along a wellbore and further having capability to flush an annular space around the tool after each interval of injection of said fluid into the hydrocarbon formation, comprising:

(i) an elongate substantially cylindrical member, having a hollow bore and an outer periphery, adapted for insertion in a wellbore;

(ii) an uphole cylindrical, hollow slidable sleeve within said bore;

(iii) a dump port, situated in said outer periphery, configured to direct a stream of fluid radially outwardly from said tool into an annular space between said tool and the wellbore, fluid communication of said dump port with said annular space allowed and prevented by slidable movement of said uphole slidable sleeve;

(iv) an uphole packer member, situated on a portion of said periphery downhole of said dump port;

(v) a downhole packer member, situated on a portion of said periphery downhole of said uphole packer member and spaced apart therefrom;

(vi) a frac port in said periphery of said cylindrical member, intermediate said uphole and said downhole packer members;

(vii) a slidably moveable guide member, having radially protruding slip members thereon, said slip members configured to frictionally engage said wellbore casing when said tool is inserted therein, said guide member situated on said tool downhole of said downhole packer member, said guide member further having radially expandable jaw members on an uphole side thereof; and (viii) a 'j' slot subassembly within said tool, situated downhole of said downhole packer member, and having an associated cylindrical hollow mandrel with a slotted profile therein, said 'j' slot subassembly, when downward force is applied to said tool and said guide member frictionally engages said wellbore casing, does not allow further relative downward movement of a lower portion of said downhole packer member relative to said guide member and thus does not allow said jaw members to become actuated, and said 'j' slot subassembly when an upward pulling force is applied to said tool and thereafter a downward force is re-applied to said tool, is then in a 'set' position where said lower portion of said downhole packer member is allowed further downward downhole movement to allow said lower portion of said downhole packer member to be forced against said jaw members so as to expand them radially outwardly to engage said wellbore casing; and wherein slight upward movement of the tool after said tool has been configured in said 'set' position within said wellbore causes said slidable sleeve to uncover said dump port and allow a flushing fluid to be delivered via the bore of said tool to said annular space.

Preferably, the uphole slidable sleeve is adapted to be slidably moved so as to uncover said dump port when the guide member and the outer periphery possessing the dump port remain stationary at a specific location within said wellbore and a portion of the tool uphole of the dump port and including the slidable sleeve is raised uphole.

Alternatively, the uphole slidable sleeve is adapted to be moved so as to uncover the dump port by a pick-up tool insertable within said bore of said tool.

In a refinement of this third embodiment, the tool is provided with an annular cup seal on the periphery of said tool intermediate the dump port and the said downhole packer member, which reduces flow of abrasive pressurized fluid and associated wellbore casing cuttings downhole.

In a further refinement, an expandable chamber and associated piston member is provided, wherein the chamber is adapted to receive fluid under pressure from the bore and cause the associated piston member, when the fluid is supplied to said bore, to compress and outwardly expand said uphole packer member;

In a still-further refinement, the tool possesses a bypass port in the periphery to allow bypass of fluid in the wellbore so as to circumvent the packers, when repositioning the tool. The bypass port is preferably situated uphole of the downhole packer, configured when open to provide fluid communication between an exterior of the tool and the hollow bore thereof and permit fluid exterior to said tool and above the downhole packer member to flow into said hollow bore; and a slidable valve member which slidably opens and closes the bypass port; and wherein when an upward force is exerted on said tool the slidable valve member is in an open position thereby keeping open said bypass port, and wherein subsequently actuating the 'j' slot to the 'set' position by subsequent downward force on the tool and/or fluid pressure being further applied to the hollow bore uphole of the slidable valve member, the slidable valve member moves to a closed position thereby closing the bypass port.

In a still further refinement, the bore of the tool, in the region of said frac port, is provided with a deflector to deflect fracking fluid out the frac port.

In a fourth embodiment, the invention relates to a method for fracturing a hydrocarbon formation by injecting a pressurized fracking fluid containing said into said formation and repositioning such tool at various spaced intervals along a wellbore, which advantageously provides for a flushing step immediately prior to repositioning the tool for another fracking operation at a further uphole site along the wellbore.

Accordingly, in such embodiment of the present invention the method comprises the steps of:

(i) running said tool, which possesses a hollow bore in the region of a dump port and a frac port thereon, into said wellbore to a desired depth within said wellbore;

(ii) pulling upwardly on said tool to configure a 'j' slot on said tool from a "running" position of step (i) to a "pulling" position and positioning an uphole and downhole packer member situated on said tool on mutually opposite sides of a region along said wellbore which is desired to be fracked;

(iii) pushing slightly down on an upper portion of said tool to cause said 'j' slot to allow movement of a portion of the tool wherein jaw members on said tool are forced against said wellbore and a downhole packer member on said tool is longitudinally compressed and caused to expand radially outwardly, so as to configure said tool in a "set" position;

(iv) injecting said pressurized fracking fluid into said wellbore and into a bore of said tool and causing said pressurized fluid to pass via a frac port in said tool into fissures created in said formation extending radially outwardly from said wellbore;

(v) ceasing supply of said pressurized fracking fluid to said bore of the tool;

(vi) pulling upwardly on the tool to disengage the jaw members and re-configure the 'j' slot into said "pulling" configuration, and simultaneously causing a slidable sleeve covering said dump port to move so as to uncover said dump port; and (vii) providing a flushing fluid not containing sand to the hollow bore of the tool and causing said flushing fluid to be expelled from the bore of the tool via the dump port and thereby flushing an annular space between the wellbore and the tool with said flushing fluid, and (viii) thereafter pulling the tool further uphole for further subsequent injection of pressurized fluid containing sand into additional fissures created in the formation.

In a refinement of the above method, such method further comprises the step, at the time of performing step (iv) and injecting said pressurized fracking fluid into said bore, of causing a piston member in said tool to longitudinally compress an uphole packer member on said tool and cause said uphole packer member to expand radially outwardly.

In a still further refinement of the above method, step (iii) further comprises the step, when pushing downwardly on a portion of the tool uphole of the downhole packer, of closing a bypass port to thereby prevent the otherwise bypass of frac fluid downhole.

Alternatively, step (iv) may instead further comprise the step, when supplying pressurized fluid to said bore of said tool, of closing a bypass port to thereby prevent the otherwise bypass of frac fluid downhole.

Lastly, in a still further refinement of the above method, step (vi) of causing the slidable sleeve covering said dump port to move so as to uncover said dump port comprises the step of inserting a pick up tool within said wellbore and said bore of said tool to move said slidable sleeve uphole to a position uncovering said dump port.

BRIEF DESCRIPTION OF THE DRAWINGS

Further advantages and permutations and combinations of the invention will now appear from the above and from the following detailed description of the various particular embodiments of the invention, taken together with the accompanying drawings each of which are intended to be non-limiting, in which.

DETAILED DESCRIPTION OF SOME PREFERRED EMBODIMENTS

Figure 1:
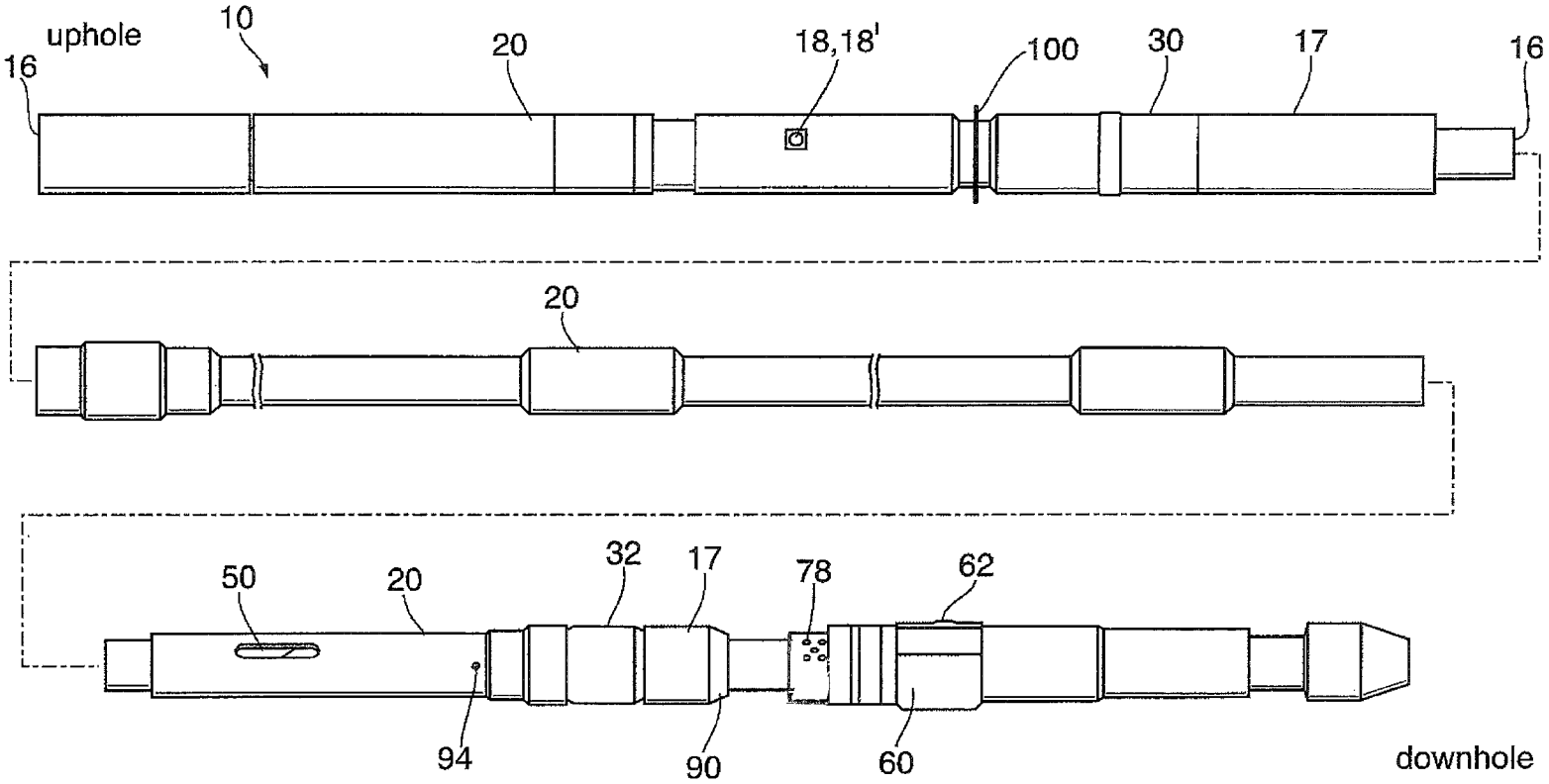
FIG. 1 is a perspective view of a first embodiment of the downhole tool of the present invention, broken into three individual segments for illustrative purposes only.

In the following description, similar components in the drawings figures are identified with corresponding same reference numerals.

Figure 2A:
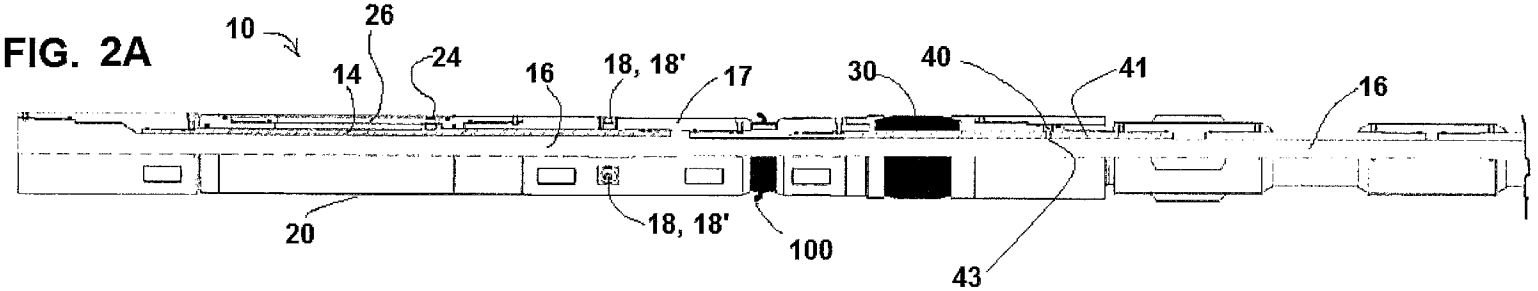
FIG. 2A is a partial cross-sectional view of the uphole portion of a first embodiment of the downhole tool, with the uphole portion of the tool being on the left-hand side of FIG. 2A, when the tool is being "run" into the wellbore.
Figure 3A:
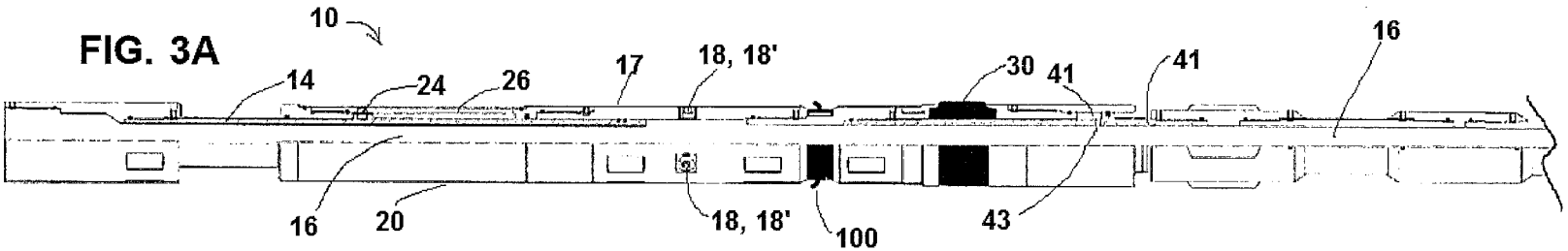
FIG. 3A is a partial cross-sectional view of the first embodiment of the downhole tool, again showing the upper portion of the tool, but when the tool is in the "pulling" position wherein a portion of the tool has been pulled uphole for effecting operation of the 'j' slot.
Figure 4A:
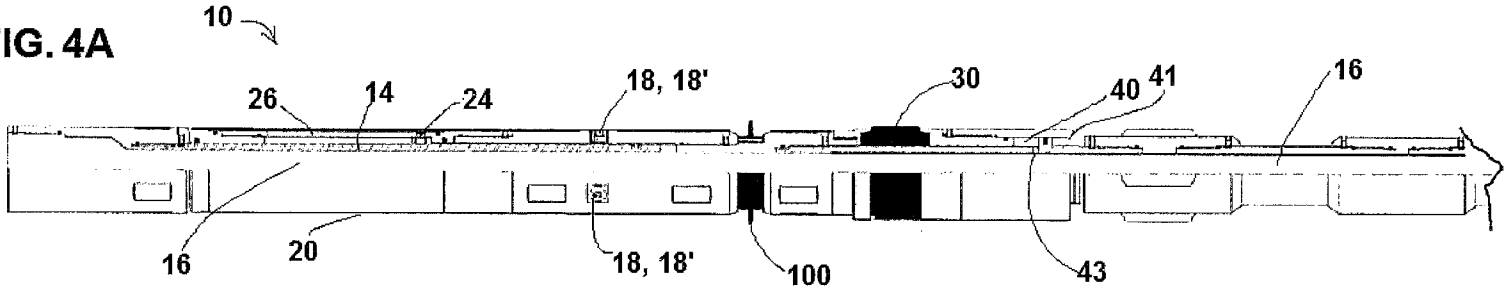
FIG. 4A is a partial cross-sectional view of the same first embodiment of the downhole tool, again showing the upper portion of the tool, with the uphole portion of the tool being positioned on the left-hand side of FIG. 4A, but instead when the tool is in the "set" position after a downhole force has subsequently been applied to the tool from the "pulling" position shown in FIG. 3A & FIG. 3B.
Figure 2B:
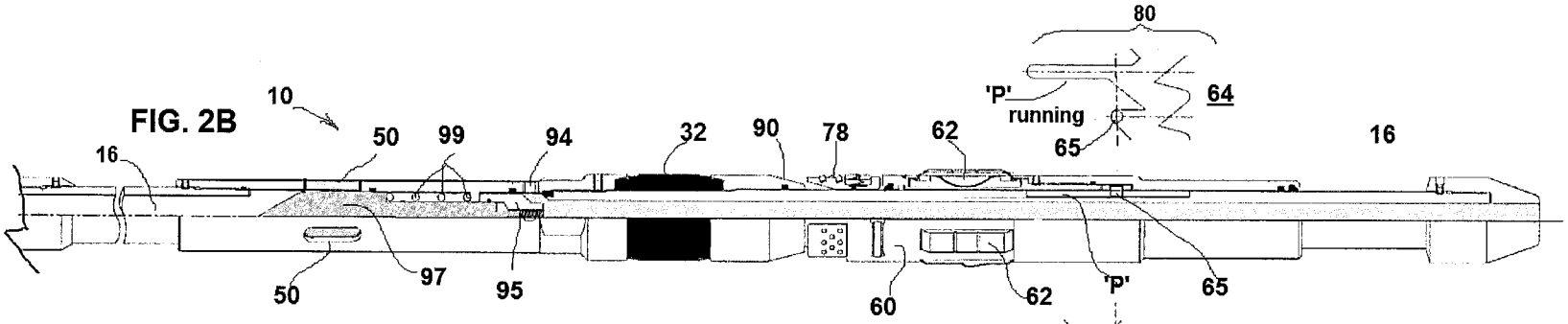
FIG. 2B is a partial cross-sectional view of the lower portion of the tool of FIG. 2A, with the downhole portion of the tool being on the right hand side of FIG. 2B and when the tool is being "run" into the wellbore, further showing in relief a view on the exterior of the tool in the region of 'j' slot, showing the position of such 'j'-slot sub-assembly when the tool is in the "running" position.
Figure 3B:
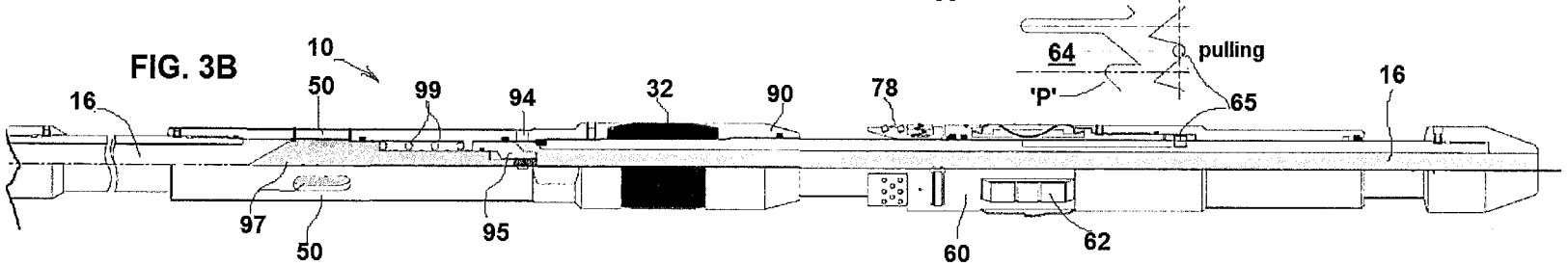
FIG. 3B is a partial cross-sectional view of the first embodiment of the downhole tool, showing the lower portion of the tool of FIG. 3A, again showing the downhole portion of the tool being on the right-hand side of FIG. 3B, when the tool is configured in the "pulling" position, further showing in relief a view on the exterior of the tool in the region of 'j' slot sub-assembly and such 'j'-slot sub-assembly when the tool is in the "pulling" position.
Figure 4B:
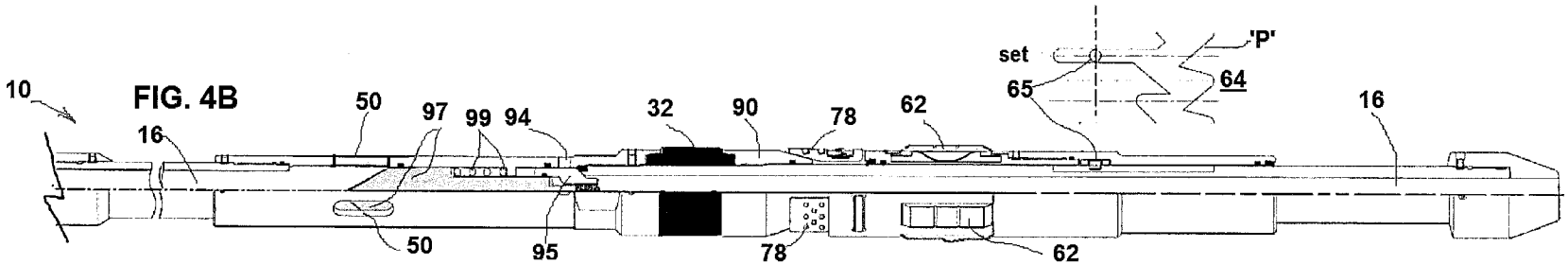
FIG. 4B is a partial cross-sectional view of the same first embodiment of the downhole tool shown in FIG. 4A, showing the lower portion of the tool, again showing the downhole portion of the tool being positioned on the right-hand side of FIG. 4B, when the tool is configured in the "set" position, further showing in relief a view on the exterior of the tool in the region of 'j' slot sub-assembly, showing the position of such 'j'-slot sub-assembly when the tool is in the "set" position.

FIG. 1 and FIGS. 2A, 2B, 3A, 3B, 4A, 4B together illustrate one embodiment of the downhole tool 10 of the present invention, with FIG. 1 depicting the tool 10 separated into three individual segments for illustrative purposes only, with remaining FIGS. 2A, 3A, and 4A showing an upper portion of the same tool 10 in three successive stages of operation (as hereinafter further explained), with corresponding FIGS. 2B, 3B, and 4B showing the lower portion of the same tool 10 in the same three successive stages of operation.

As may be seen, tool 10 is adapted for insertion in a wellbore casing (not shown), and comprises an elongate substantially cylindrical member 20. Cylindrical member 20 possesses a hollow bore 16 for receiving pressurized abrasive fluid and a frac fluid (which in one particular embodiment, as mentioned above, may be one and the same fluid), and further possesses an outer periphery 17. A cylindrical hollow slidable sleeve 14 is positioned within bore 16, adapted for longitudinal slidable movement along bore 16 in a reciprocating manner.

One or more jet ports 18 are provided in outer periphery 17 which are configured to direct a stream of pressurized abrasive fluid, typically a fluid containing quantities of sand and/or silica granules, radially outwardly from the tool 10, for impacting and creating perforations in a surrounding wellbore casing. Jet ports 18, typically two or more being located at a similar longitudinal position along cylindrical member 20 as shown in FIGS. 2A-4A and 6A-8A, typically comprise jet nozzles 18' of hardened steel having an single aperture therein, which are thread ably inserted into periphery 17 of tool 10 and are retained in periphery 17 by threaded bosses 19.

In one preferred embodiment the diameter of an exit aperture in each jet nozzle 18' is 0.0241 inches (0.61 mm) for creating perforations in the wellbore casing of similar size. At pressures of approximately 3,000 psi (20,685 kPa), with production wellbore casing thicknesses of ¼ inch (6.35 mm) (Schedule 20) carbon steel for a nominal 8.625 inch (193 mm) o.d. casing, with fine silica sand of 20-40 API mesh size (0.84-0.42 mm) (i.e. diameter less than 0.241 inch) and three nozzles, the penetration time using a jet nozzle 18' will take in the range of 30 seconds to create a perforation of desired size in the casing. A similar time to perforate a wellbore casing exists when the casing is of cement as opposed to carbon steel.

The size of perforations desired to be created in wellbore casing (which is in turn dependent upon, inter alia, the characteristics (temperature, viscosity, and physical properties of the actual hydrocarbons which are being recovered from the underground formation) will determine the size of the aperture of each nozzle 18". Typically two, and up to four, jet nozzles 18' will be located at a similar longitudinal position on periphery 17 of cylindrical member 20. For optimum adaptability of tool 10, threaded bosses 19 on periphery 17 to tool 10 in which the jet port nozzles 18' are threadably inserted are adapted to receive a variety of nozzles 18' of varying apertures diameters, depending on the size of the perforations desired to be created in the wellbore casing.

Figure 7A:
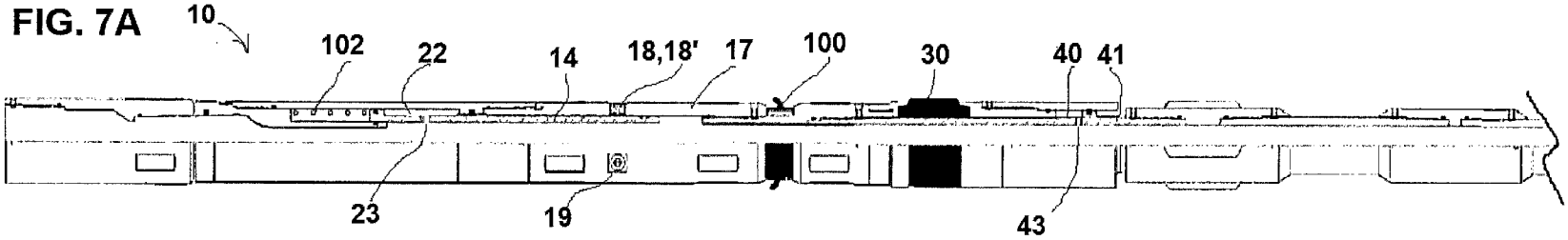
FIG. 7A is a partial cross-sectional view of the same second embodiment of the downhole tool, again showing the upper portion of the tool (the lower portion of the tool remaining the same as in FIG. 3B), with the uphole portion of the tool being positioned on the left-hand side of FIG. 7A, but instead when the tool is in the "pulling" position wherein a portion of the tool having been pulled uphole for effecting operation of the 'j' slot.
Figure 8A:
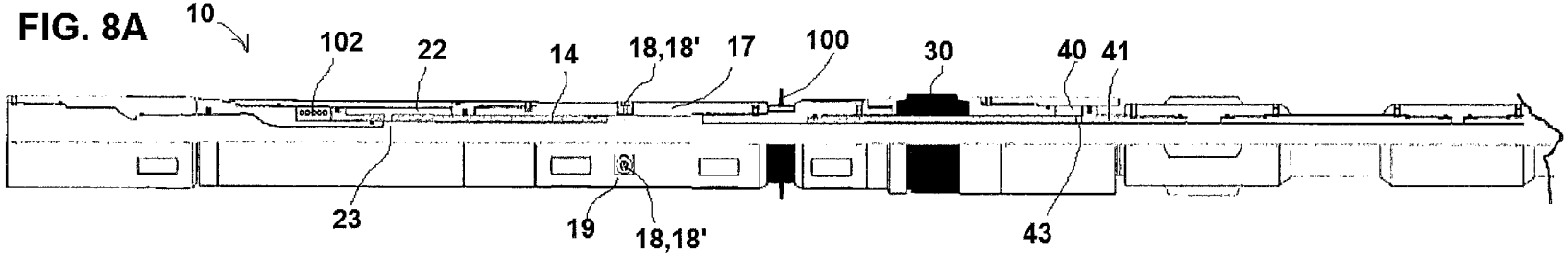
FIG. 8A is a partial cross-sectional view of the same second embodiment of the downhole tool, again showing the upper portion of the tool (the lower portion of the tool remaining the same as in FIG. 4B), with the uphole portion of the tool being positioned on the left-hand side of FIG. 8A, but instead when the tool is in the "set" position after a downhole force has subsequently been applied to the tool from the "pulling" position shown in FIG. 7A.

Fluid communication between jet ports 18 (jet nozzles 18') and inner bore 16 is regulated by slidable sleeve 14, which when slidably positioned over jet ports 18 prevents fluid communication between bore 16 and jet ports 18, effectively closing the jet ports 18. Movement of slidable sleeve 14, either by: (i) application of an uphole force to draw slidable sleeve 14 upward (ref. FIG. 3A), (ii) use of a "pick-up" tool (not shown), inserted downhole into bore 16 when tool 10 is at a location along a wellbore where a perforation therein is desired to be created, or (iii) by injection of a pressurized fluid in bore 16 which thereafter enters chamber 22 and causes slidable sleeve 14 to act as a piston (ref. FIG. 7A, 8A) so as to thereby be caused to move so as to open jet port 18, are all alternative and different ways in which slidable sleeve 14 may be actuated to respectively allow and prevent fluid access from bore 16 to jet ports 18.

In the embodiment of the invention shown in FIGS. 2A, 3A, and 3B, slidable sleeve 14 is guided by a pin member 24 travelling in longitudinal slot 26 to ensure longitudinal guided movement of slidable sleeve 14 within cylindrical member 20 and bore 16, and to provide extremities of movement for such slidable sleeve 14.

An uphole packer member 30 is situated on a portion of periphery 17 of tool 10, downhole of jet ports 18. An expandable chamber 40 and associated piston member 41 are provided, wherein chamber 40 is adapted to receive fluid under pressure from bore 16 and cause said associated piston member 41, when pressurized fluid is supplied to bore 16, to compress and outwardly expand uphole packer member 30 to create a seal in the wellbore, between the tool and the wellbore casing.

A downhole packer member 32 is further provided, situated on a portion of periphery 17 of tool 10 downhole from uphole packer member 30, as shown in FIGS. 1, 2B, 3B, & 4B. Downhole packer member 32 is typically comprised of an elastomeric substance, and in uncompressed when in a non-activated state, as shown in FIGS. 2B & 3B. Upon high pressure fluid, such as a fracking fluid, being provided to bore 16, such high pressure fluid flows into chamber 40 via aperture 43 in piston member 41 causing expansion of chamber 40 as may be seen in FIG. 3A. Expansion of chamber 40 causes piston member 41 to compress upone packer member 30, thereby creating a seal between tool 10 and wellbore casing at the location of uphole packer member 30 in the wellbore.

One or more frac ports 50 are provided on tool 10 circumferentially about the periphery 17 of cylindrical member 20. Frac ports 50 are located on tool 10 intermediate uphole packer member 30 and downhole packer member 32.

A slidably moveable guide member 60, having radially protruding slip members 62 which frictionally engage the wellbore casing when tool 10 is inserted in the casing, is provided. Guide member 60 is situated on tool 10 downhole of downhole packer member 32. Guide member 60 is further provided with radially expandable jaw members 78, on an uphole side thereof, as shown in FIGS. 2B, 3B & 4B.

A 'j'-slot subassembly 80 is provided on tool 10, situated downhole of downhole packer member 32. 'J'-slot subassembly 80 comprises an inner mandrel member 64, having a slotted profile "P" therein, and a pin member 65 which travels in slotted profile "P".

Figure 6A:
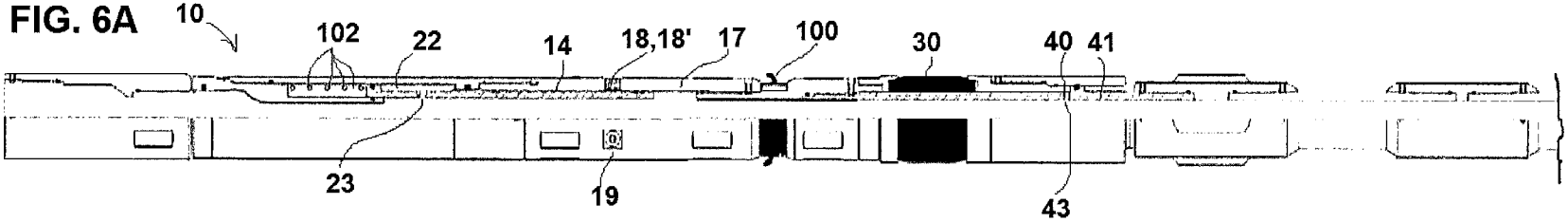
FIG. 6A is a partial cross-sectional view of a second embodiment of the downhole tool, showing the upper portion of the tool (the lower portion of the tool remaining the same as in FIG. 2B), with the uphole portion of the tool being positioned on the left-hand side of FIG. 6A, when the tool is being "run" into the wellbore.

When the 'j'-slot subassembly 80 is in the 'run' position (ref. FIG. 2A, 2B, and FIG. 6A) and downward force is applied to tool 10 guide member 60 frictionally engages the wellbore casing. In such "run" position, the slotted profile "P in associated mandrel member 64 does not allow further relative downward movement of a wedge-shaped lower portion 90 of downhole packer member 32, and thus does not allow jaw members 78 to become actuated.

When an upward pulling force is applied to tool 10 (ref. FIG. 3A, 3B, and FIG. 7A) and thereafter a downward force is re-applied to said tool 10 (ref. FIG. 4A, 4B, and FIG. 8A), the 'j'-slot subassembly becomes configured in the 'set' position where:

(i) the wedge-shaped lower portion 90 of downhole packer member 32 is allowed further downward downhole movement to allow said lower portion 90 to be forced against jaw members 78 so as to expand them radially outwardly to engage the wellbore casing, and thereby fix the tool 10 within the wellbore casing to allow fracking to be carried out.

In a preferred embodiment a bypass port 94 is provided, uphole of the downhole packer member 32, configured when open to provide fluid communication between an exterior of tool 10 and interior bore 16 and permit fluid exterior to tool 10 and above said downhole packer member 32 to flow into said bore. With such bypass port 94 the tool 10 may be more easily pulled uphole than would otherwise be the case. A slidable valve member 95 slidably opens and closes said bypass port 94.

When an upward force is exerted on the tool 10 slidable valve member 95 is in an open position thereby keeping open bypass port 94. When subsequently actuating said 'j' slot subassembly 80 to the 'set' position by subsequent downward force on tool 10, and/or frac pressure is applied to bore 16, slidable valve member 95 is moved to a closed position thereby closing bypass port 94.

In the embodiments of the tool shown in FIGS. 2B, 3B, & 4B, the slidable valve member 95 which is provided is moved to the closed position in FIG. 4B, by hydraulic frac fluid being applied to bore 16, which thereby moves spring-biased conical deflector 97 downhole, thereby moving slidable valve member 95 to cover and thereby close bypass port 94. In an alternative configuration (not shown) mandrel 64 may further or alternatively be configured, to that when the "j'-slot subassembly 80 is in the "set" position, that bypass port 94 is thereby closed, either by mandrel 64 itself, or by mandrel 64 actuating slidable valve member 95 to close bypass port 94.

Numerous other configurations to effectively close bypass port 94 upon 'j' slot subassembly 80 moving to the "set" position (as shown in FIG. 4B) will now occur to persons of skill in the art, and all such variations are within the contemplation of this invention. Similarly, conical deflector 97 is shown in FIGS. 2B & 3B as being biased by a helical coil spring 99 to close port 50 and leave bypass port 94 open, unless a fluid pressure is supplied to bore 16, allow conical deflector 97 to leave slidable valve member 95 in a position where bypass port 94 is closed and port 50 is open (ref. FIG. 4B) open. Other means of biasing conical deflector 97, other than by spring means, to accomplish the aforesaid result will now occur to persons of skill in the art, and such permutations and substitutions are likewise contemplated as forming the invention described herein.

FIGS. 6A, 7A, 8A show successive operation of an alternative embodiment of the upper portion of the tool 10 (the bottom portion of the tool 10 being identical to the configurations successively depicted in corresponding successive FIGS. 2B, 3B, & 4B) in particular with regard to the manner of actuation of the sliding sleeve 14, where such embodiment is specifically adapted to both perforate and frac at the same time.

The components of the bottom portion of the tool 10, for the embodiment shown in successive FIGS. 6A, 7A, & 8A, are identical and correspond to the configuration shown in corresponding successive FIGS. 2B, 3B, and 4B. Specifically, FIG. 6A (and corresponding bottom portion of the tool 10 in such embodiment shown in FIG. 2B) shows the tool 10 of such embodiment in the "run in" position. FIG. 7A (and corresponding bottom portion of the tool 10 in such embodiment shown in FIG. 3B) shows the tool 10 of such embodiment in the "pulling" position. Lastly, FIG. 8A (and corresponding bottom portion of the tool 10 in such embodiment shown in FIG. 4B) shows the tool 10 of such embodiment in the "set" position.

In such alternative embodiment shown in FIGS. 6A, 7A, and 8A, slidable sleeve 14 has a port 23 therein and is configured so as to form a chamber 22. After the tool 10 is moved slightly uphole to the "pulling" position shown in FIGS. 7A & 3B) and then moved downwardly to allow the 'j'-slot to move to the "set" position (ref. FIGS. 8A & 4B) pressurized abrasive fluid is the supplied to bore 16 of tool 10. Such pressurized fluid enters chamber 22 via port 23 and causes slidable sleeve 14 to automatically move uphole as shown in FIG. 8A, thereby uncovering jet port 18 to thereafter allow the perforation operation to be performed. In this alternative embodiment/alternative method, the pressurized abrasive fluid also serves as the fracking fluid. In such case, the foregoing embodiment allows simultaneous creation of an uphole perforation in the wellbore casing when such sliding sleeve 14 is opened, while at the same time fracking of the formation being simultaneously conducted by a lower portion of the tool 10, since upper and lower packer members 30, 32 respectively now "straddle" an earlier-created perforation in the wellbore casing, and pressurized abrasive/fracking fluid is injected into the formation via such lower earlier-created perforation.

In the preferred embodiments of the upper portion of the tool 10 shown in FIGS. 2A, 3A, & 4 A, and 6A, 7A, & 8A, such upper portion 10 is provided with an annular cup seal 100 on periphery 17 of tool 10. Such annular cup seal 100 is situated intermediate jet port 18 and said downhole packer member 32, and serves to reduce flow of abrasive pressurized fluid and associated wellbore casing cuttings downhole during the casing perforation operation, which is part of the method of the present invention more fully explained below.

Manner of Operation of Tool, and Methods for Perforating Wellbore Casing and Fracking a Formation Using the Single Tool A broad outline of a method for operating the tool 10 and methods for perforating a wellbore casing and fracking a formation using a single tool 10 are set out below and are depicted successively in FIGS. 2A, 2B, 3A, 3B & 4A,4B, and likewise successively for the alternative embodiment shown in FIGS. 6A, 7A & 8A (with corresponding lower portions of the tool 10 shown respectively in FIGS. 2B, 3B, & 4B).

In the method, broadly described, tool 10 is initially run into a wellbore casing to a desired depth in the wellbore casing. During such run-in, and as shown in FIG. 2A and FIG. 6A, slidable sleeve 14 covers jet port 18. Frac port 50 may be in an open or closed position (shown in the closed position in FIGS. 2*b* & 3B and in the open position in FIG. 4B), and likewise for bypass port 94 may be in an open or closed position (shown in the open position in FIGS. 2B, 3B and in the closed position in FIG. 4B). Thereafter, when the tool 10 has been lowered to the lowermost portion of the wellbore which is desired to be perforated and fracked, slight upward movement of tool 10 (ref. FIGS. 3A, 3B) pulls slidable sleeve 14 uphole, while guide member 60 and slips 62 thereon generally keep the remainder of tool 10 at a fixed position within the wellbore, thusly opening jet port 18 and jet nozzles 18'.

An abrasive pressurized fluid containing an abrasive compound such as uniformly sized sand particles or tungsten carbide filings of small uniform dimension, is then injected into bore 16. Such fluid not only enters chamber 40 through port 43 and caused piston 41 to compress uphole packer member 30 to thereby create a seal between tool 10 and the wellbore casing at such location, thereby preventing flow of abrasive fluid downhole, at such time the pressurised fluid is further expelled in a radially outward manner from jet ports 18 and jet nozzles 18' to thereby impinge upon the wellbore casing, and after a short time interval of impingement, perforate the casing at such location, with perforations equal in number to the number of jet ports 18 (ref. FIGS. 3A, 3B)

It is noted that slidable sleeve 14 in the method of the present invention need not necessarily be opened by slight upward force on the tool string and tool 10, as described above, but rather in an alternative embodiment shown in FIGS. 6A, 7A, and 8A, such slidable sleeve 14 is configured so as to form a chamber 22, and is opened by pressurized fluid being supplied to such chamber 22. This variation is described further below.

After the above perforation operation is performed, injection of pressurized abrasive fluid is ceased, and tool 10 may then be further drawn uphole to thereby position both the uphole packer member 30 and the lower (downhole) packer member 32 of tool 10 on the uphole and downhole side, respectively, of the created perforation, so as to effectively "straddle" the perforation with packer members 30, 32.

Thereafter, and as shown in FIGS. 4A&B, further downward force is re-applied reapplied to the tool 10 to move slidable sleeve 14 downward (downhole) to cover jet ports 18 and to further actuate 'j' slot subassembly to allow wedge-shaped lower portion 90 of lower packer member 32 to be forced against jaw members 78, thereby causing such jaw members 78 to be forced radially outwardly and thus against the wellbore casing so as to thereby temporarily secure tool 10 within the wellbore casing. Simultaneously, by downhole packer member 32 being forced against jaw members 78 of guide member 60, the downhole packer member 32 is compressed and caused to expand radially outwardly, thereby creating a seal between the tool 10 and the wellbore casing at that location.

Thereafter, as shown in FIGS. 4A&B, pressurized fracking fluid is injected into bore 16, which causes piston member 41 in said tool 10 to compress said uphole packer member 30 and cause said uphole packer member 30 to expand radially outwardly, and thereby cause the pressurized fluid to pass into said the created perforation via frac port 50 in tool 10.

Thereafter, after completion of the fracking of the wellbore and this particularly location, supply of the pressurized fracking fluid is ceased and an upward force is then re-applied to the tool 10 to disengage jaw members 78 and allow re-positioning of tool 10 further uphole for creating further perforations and injecting further fracking fluid into further created perforations at such locations.

Figure 5:
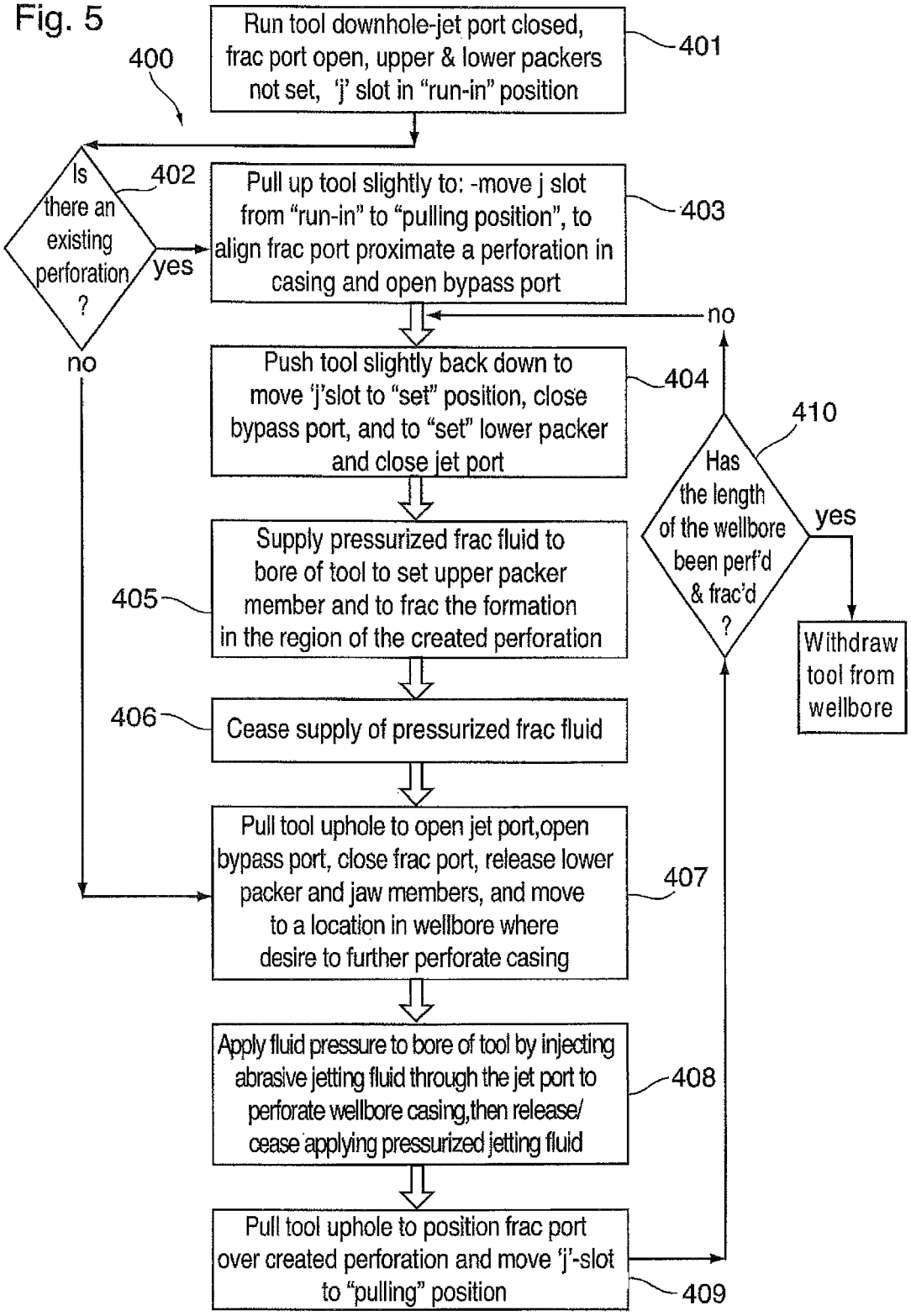
FIG. 5 is a flow diagram of a particular method of the present invention for perforating a wellbore casing and fracking the formation via the created perforations.

FIG. 5 shows a further elaboration/itemization of one particular method 400 of the present invention, using the tool 10 configuration shown in FIGS. 2A, B, 3A, 3B, & 4A, 4B, and where a bypass port 94 further is utilized.

In step 401, tool 10 is run downhole. Jet port 18 remains closed, and frac port 50 remains open, and neither upper packer member 30 or lower packer member 32 are "set" (i.e. compressed), thereby allowing the tool 10 to be run in into the wellbore, to a desired lowest depth where perforations and fracking is desired to be conducted. The 'j' slot subassembly 80, namely pin member 65 within slot "P" of mandrel 62, is in the "run in" position as shown in FIG. 2B If there is an existing perforation in the wellbore, the operator will, as shown in step 402, elect to proceed to step 403 to pull up slightly on the tool 10 to move the j-slot 80 from the run-in" position to the "pulling position" as shown in FIG. 3B, to thereby align frac port 50 proximate the perforation, and thereby also open bypass port 94 (If no existing perforation, the operate will proceed with step 407, described below). Thereafter, in step 404 the operator will push tool 10 slightly back down in the wellbore, to move 'j' slot subassembly 80 to the "set" position (ref. FIG. 4B), and simultaneously set (i.e. compress) the lower packer member 32 and jaw members 78, close bypass port 94, and close jet port 18.

In subsequent step 405, pressurized frac fluid is then supplied to bore 16 to tool 10, to "set" (i.e. compress) upper packer member 30 by movement of piston 41, and frac fluid is injected into the formation in the region of the created perforation by supply of frac fluid to frac port 50 and thereby to the formation.

After fracking, tool 10 is pulled uphole in step 407 to thereby open jet port 18 and bypass port 94, release lower packer 32 and jaw member 78, and allow movement of tool 10 to an uphole location in the wellbore where desired to further perforate the casing.

In subsequent step 408, abrasive fluid is supplied to bore 16 of tool 10, and subsequently through jet port 18 to perforate the wellbore casing at such new uphole position, and thereafter the supply of such abrasive pressurized fluid is ceased.

In subsequent step 409, the tool 10 is pulled further uphole to position frac port 50 over the newly created perforation, and move 'j'-slot 80 to the "pulling" position.

If the desired length of the wellbore has not been completely perforated and fracked, the completion engineer reverts to step 404, and re-execute steps 404-409 at such further location in the wellbore. Otherwise, if at such point the wellbore has been completely perforated and fracked to the extent desired, the tool 10 can then be removed from the wellbore.

The operation of the configuration of tool 10, having the configuration shown in FIGS. 6A, 7A, & 8A, allows both perforation and fracking to be simultaneously carried out, and necessarily involves the abrasive fluid being one and the same as the frac fluid.

Such further refinement to the method 400 comprises simultaneously with step 405 injecting the abrasive/frac fluid, causing, by injection of such abrasive/frac fluid, the slidable sleeve 14 to move to an open position and expelling said abrasive/fracking fluid in a radially outward manner via said jet port 18 to thereby create a further perforation in the wellbore. Step 409 further comprises the step of repositioning the tool 10 further uphole so as to further position upper packer member 30 above the further created perforation, and again supplying the abrasive/fracking fluid to tool 10 when in such further position, to frac the formation in the region of the further perforation in the wellbore, and at the same time to further create an additional uphole perforation.

Third Embodiment of the Tool, and Method for Fracking Using Such Tool

As noted in the Summary of the Invention, in a further aspect the present invention provides a downhole tool which not only successively fracs at spaced intervals along a perforated wellbore, but is further provided with what is figuratively referred to herein as a "dump valve" which may be opened, if desired or considered necessary, to allow flushing of an annular space surrounding the frac tool with a flushing fluid after every successive frac operation carried out, so as to reduce the risk of the fracking tool, and thus the frac string, from becoming "sanded-in".

More particularly, the present invention in a third embodiment thereof comprises a downhole tool for injecting a fluid into a hydrocarbon formations at various spaced intervals along a wellbore and further having capability to flush an annular space around the tool after each interval of injection of said fluid into the hydrocarbon formation.

With reference to FIGS. 9A & 9B, FIGS. 10A & 10*b*, FIGS. 11A & 11B, FIGS. 12 & 12B, such figures depict the third embodiment of the tool of the present invention.

All numerical references identified in FIGS. 9A & 9B, FIGS. 10A & 10*b*, FIGS. 11A & 11B, FIGS. 12 & 12B having the same reference numerals as identified in respect of earlier Figures perform the same function and correspond to a similar component as those components identified in such earlier drawings figures, and their description is incorporated with regard to the aforementioned drawings.

FIGS. 9A & 9B, FIGS. 10A & 10*b*, FIGS. 11A & 11B, FIGS. 12 & 12B, and FIG. 13 all teach a tool 10 and method 800, respectively, which fracs a formation 200 at spaced intervals along a wellbore 204 but does not also perforate a wellbore or wellbore casing. Instead, in the variation of the aforementioned tool 10 as shown in the above Figures, the jet ports 18 and jetting nozzle 18' (if further provided) are merely used as (or comprise), or substituted with, "dump ports" 300 (ref. FIGS. 9A, 10A, 11A, & 12A) for providing a flushing fluid (not shown) into an annular space 202 between the tool 10 and the wellbore or wellbore casing 204 when the tool 10 is situated in the wellbore 204. Such configuration advantageously serves to reduce incidence of potential "sanding in" of the tool 10 within wellbore 204 after a fracking operation is completed at a particular interval along wellbore 204.

FIGS. 9A & 9B, FIGS. 10A & 10*b*, FIGS. 11A & 11B, FIGS. 12 & 12B, each respectively shows an upper portion (FIGS. 9A, 10A, 11A, and 12A) and a corresponding bottom portion (FIGS. 9B, 10B, 11B, and 12B), respectively, during various sequential configurations of tool 10 during a run in, fracing operation, and subsequent flushing operation with a wellbore.

Figure 9A:
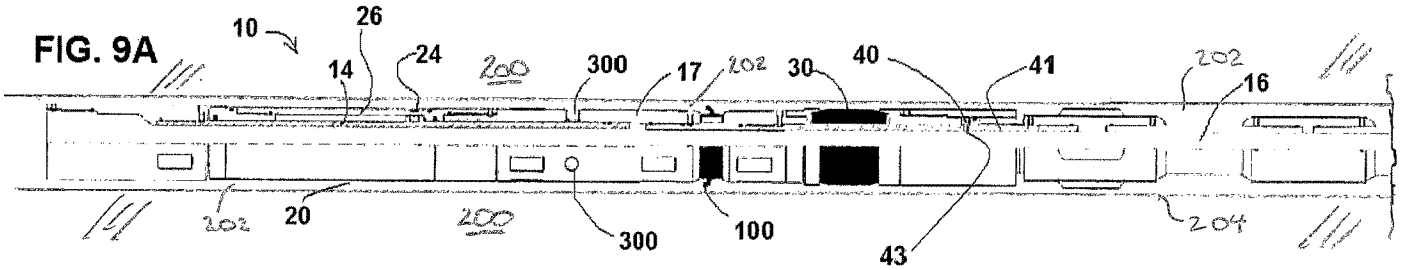
FIG. 9A is a partial cross-sectional view of an upper portion of a third embodiment of the downhole tool, with the uphole portion of the tool being the left-hand side of FIG. 9A, when the tool is being "run" into the wellbore.
Figures 9B, 10B, 11B, 12B:
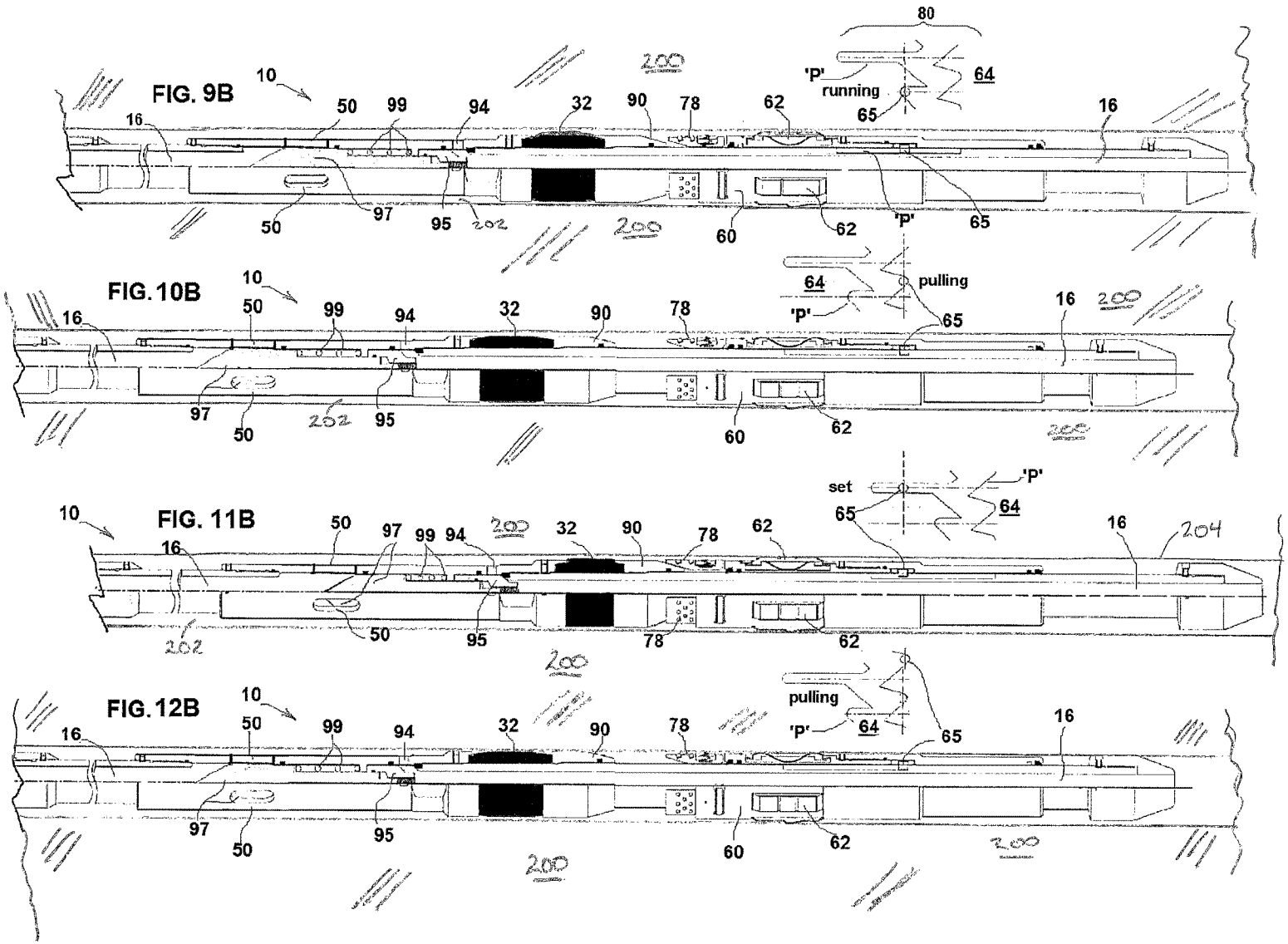
FIG. 9B is a partial cross-sectional view showing the lower portion of the tool of the third embodiment, with the downhole portion of the tool being on the right hand side of FIG. 9B and when the tool is being "run" into the wellbore, further showing in relief a view on the exterior of the tool in the region of 'j' slot, showing the position of such 'j'-slot sub-assembly when the tool is in such "running" position.
FIG. 10B is a partial cross-sectional view of the lower portion of the tool of the third embodiment, when the tool is configured in the "pulling" position, further showing in relief a view on the exterior of the tool in the region of 'j' slot sub-assembly and showing the position of such j'-slot sub-assembly when the tool is in such "pulling" position.
FIG. 11B is a partial cross-sectional view of the lower portion of the tool of the third embodiment when the tool is configured in the 'set' position, further showing in relief a view on the exterior of the tool in the region of 'j' slot sub-assembly and showing the position of such 'j'-slot sub-assembly when the tool is in such 'set' position.
FIG. 12B is a partial cross-sectional view of the lower portion of the tool when carrying out the flushing operation.

Specifically, FIGS. 9A & 9B show the configuration of each of the top portion (FIG. 9A) and bottom portion (FIG. 9B) respectively of tool 10, and in particular for the 'j'-slot 80 thereof, during an initial "running in" configuration of the tool 10.

Figure 10A:
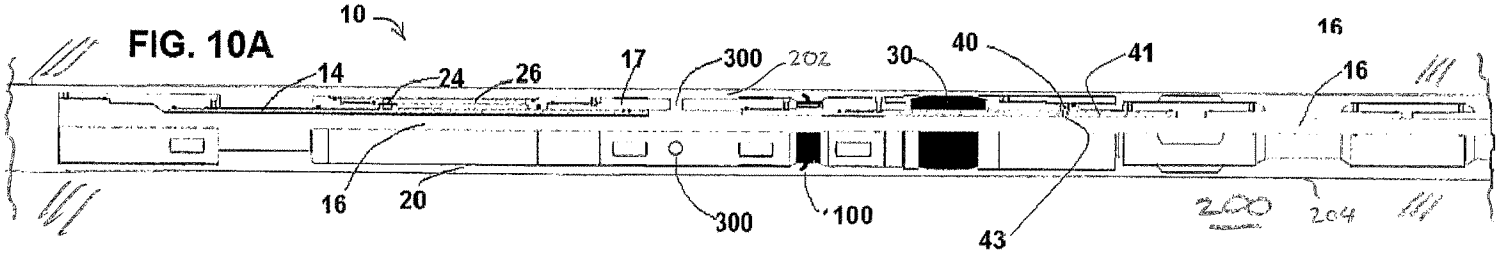
FIG. 10A is a partial cross-sectional view of the upper portion of the tool of the third embodiment, when the tool is in the "pulling" position wherein a portion of the tool has been pulled uphole for effecting operation of the 'j' slot.

FIGS. 10A, 10B show the configuration of each of the top portion (FIG. 10A) and bottom portion (FIG. 10B) respectively of tool 10, and in particular for the 'j'-slot 80 thereof, during a subsequent "pulling" stage where the tool 10 has then been pulled slightly uphole to re-configure 'j-slot 80 to the 'pulling position'

Figure 11A:
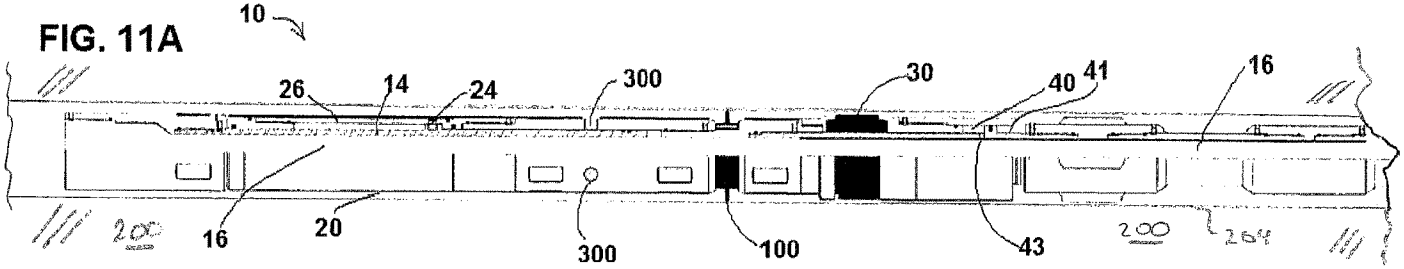
FIG. 11A is a partial cross-sectional view of the upper portion of the tool of the third embodiment, when the tool is configured in the 'set' position for fracking, and when the dump port is closed.

FIGS. 11A, 11B show the configuration of each of the top portion (FIG. 11A) and bottom portion (FIG. 11B) respectively of tool 10, and in particular for the 'j'-slot 80 thereof, during a subsequent "setting" stage where the tool 10 has then been pushed slightly downhole to re-configure 'j-slot 80 to the 'set' or 'setting' position' and align frac port 50 of tool 10 proximate a perforation (not shown) in wellbore casing 204 or proximate a desired location along wellbore 204 for the first fracking operation. Configuration of 'j'-slot 80 to the 'set' position causes/allows wedge-shaped lower portion 90 of lower packer member 32 to be forced against jaw members 78, thereby causing such jaw members 78 to be forced radially outwardly and thus against the wellbore casing so as to thereby temporarily secure tool 10 within the wellbore or wellbore casing 204. Simultaneously, by downhole packer member 32 being forced against jaw members 78 of guide member 60, the downhole packer member 32 is compressed and caused to expand radially outwardly, thereby creating a seal between the tool 10 and the wellbore or wellbore casing 204 at that location.

When tool 10 is positioned and thereby configured in the 'setting' position shown in FIG. 11A, 11B, a pressurized injection fluid (not shown) can then be supplied to the bore 16 of tool 10. Supply of such pressurized injection (fracking) fluid which typically contains high percentages of silicates of uniform diameter, will then:

(i) push down on spring-biased conical deflector, and cause bypass port 94 to then be closed;

(ii) in a configuration where, as described above, uphole packer member 30 is actuated by an expandable chamber 40 and associated piston member 41, chamber 40 receives fluid under pressure from bore 16 via port 43 and causes associated piston member 41 to compress and outwardly expand uphole packer member 30 to create a seal in wellbore 204; and (iii) cause high pressure frac fluid to flow out frac port 50 and into wellbore 204, and frac the formation 200 in a region between upper and lower packer members 30, 32 not only creating fissures in the formation 200 but further allowing the sand particles in the injected fluid to "prop" open the fissures to allow in the formation 200 to flow into wellbore 204 via such fissures for subsequent production to surface.

Figure 12A:
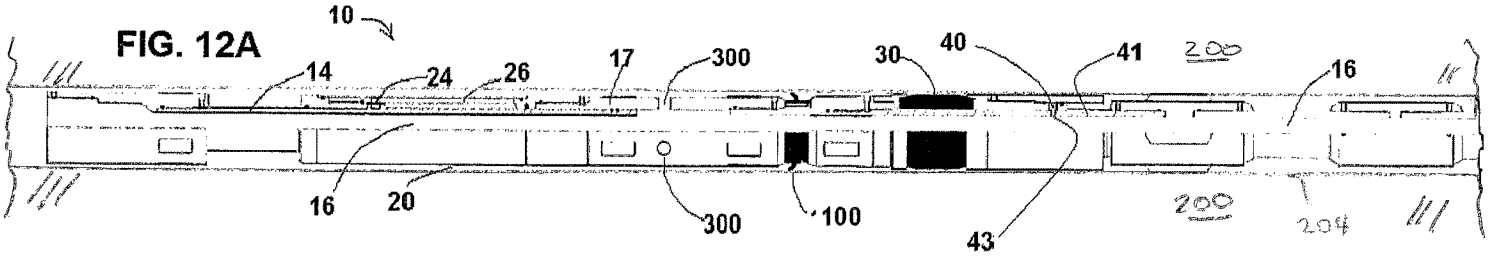
FIG. 12A is a partial cross-sectional view of the upper portion of the tool of the third embodiment, when the tool is again pulled slightly uphold so as to open the dump port in such tool to allow fluidic flushing of the annular region between the tool and the wellbore.

After the aforesaid fracking operation at the desired interval along the wellbore 204 has been completed using the modified tool 10 described above, namely by subsequent cessation of supply of pressurized fluid to frac ports 50, the tool 10 can then be configured as shown in FIGS. 12A & 12B to conduct a flushing operation.

As may be seen from the configuration of the tool as shown in FIGS. 12A, 12B, cessation of supply of high pressurized fluid results in:

(i) disengagement of sealing of uphole packer member 30 with wellbore 204, by piston 41 returning to its initial position; and (ii) return of spring-biased conical deflector to a position closing frac port 50, and opening bypass port 94.

Tool 10 may then return to the configuration shown in FIGS. 12A, 12B by pulling the tool 10 slightly upwardly while guide member 62 hold a lower portion of the tool 10 below downhole packer 32 stationary within wellbore 204, so as to release jaws' 78 engagement with wellbore 204 and release downhole packer member 32 sealing engagement with wellbore 32.

In addition, slight uphole movement of the upper portion of tool 10, or by use of a "pick-up" tool as described below, will result in sliding sleeve 14 to be moved uphole, thereby uncovering dump ports 300.

Accordingly, tool 10 when now configured to the configuration shown in FIG. 12A, 12B, may advantageously then have a flushing fluid (typical not containing any sand or low concentration of sand) supplied to bore 16 to tool 10 and caused to flow out dump port(s) 300 into annular space 202, and caused to be circulated via such annular space 202 back uphole for collection and processing. In such manner annular space 202 intermediate tool 10 and wellbore 204 may be flushed of sand in the region around the tool 10 and in all areas above the tool, thereby freeing the tool 10 for further movement uphole for progressively carrying out further fracking operations at spaced intervals uphole.

While FIG. 11A in comparison with FIG. 12A merely shows that sliding sleeve 10 and a portion of tool 10 has been pulled uphole slightly to thereby cause slidable sleeve 14 to slidably uncover dump port(s) 300, other manners of actuating the sliding sleeve 14 to uncover the dump ports 300 can be employed. For example, a commonly-known "pick-up" tool (not shown) may be inserted in hollow bore 16 of tool 10 and actuated to removably and temporarily grasp sliding sleeve 14 and when such pick-up tool is then moved uphole, causing slidable sleeve 14 to uncover dump ports 300 (as shown for example in FIG. 12A). Upon sliding sleeve 14 reaching an extremity of travel uphole, further uphole movement of sliding sleeve 14 causes disengagement of pick-up tool therewith, allowing pick-up tool to thereafter be drawn uphole and removed from the wellbore 204, and the tool 10, and particularly the bore 16 thereof, to be supplied with a flushing fluid (preferably free of sand) which flushing fluid when passing from inner bore 16 of tool 10 into annular space 202 via dump port(s) 300 then flushes annular space 202 of any entrained sand, thereby preventing tool 10 from becoming sanded in within wellbore 204.

Figure 13:
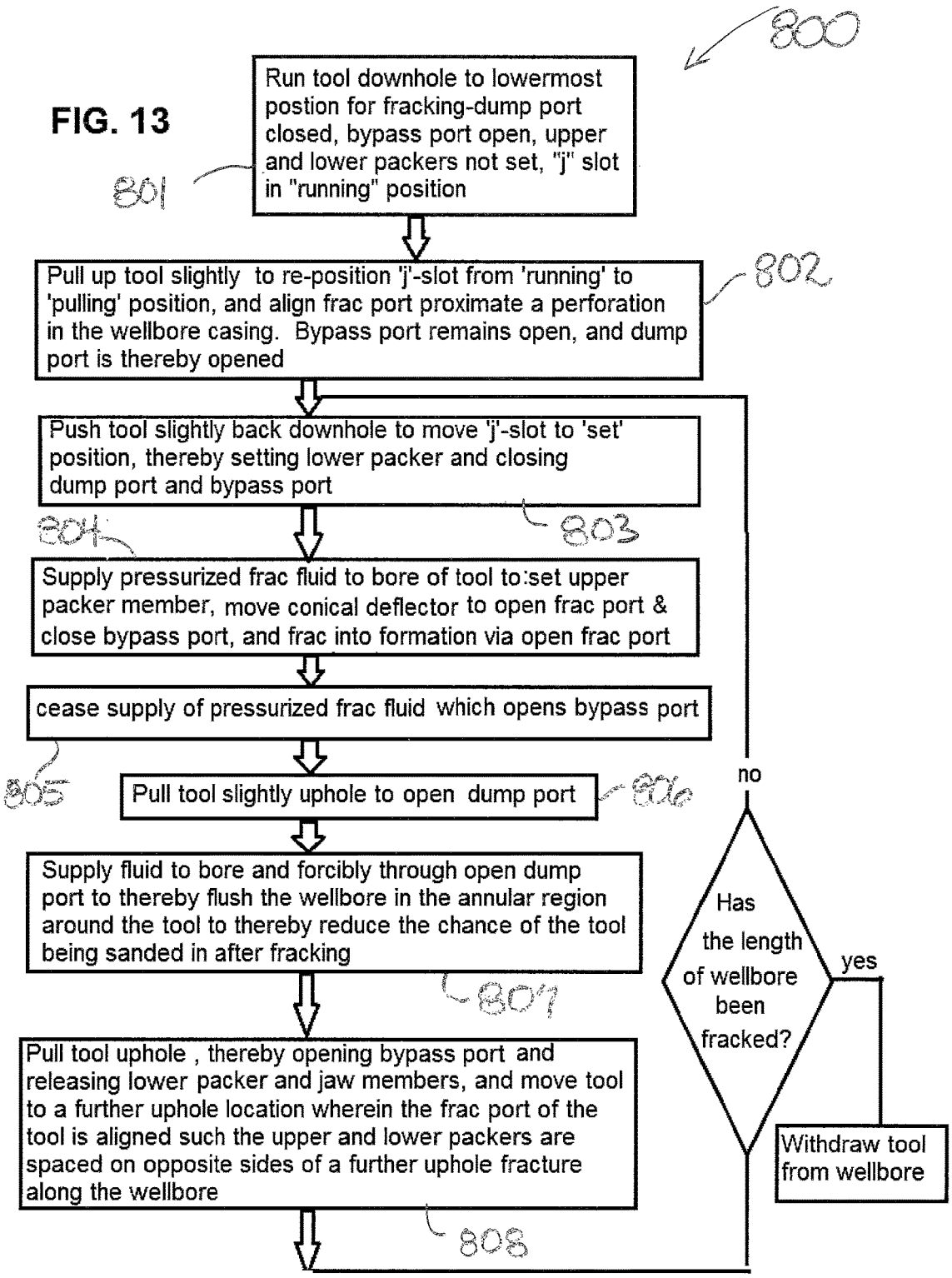
FIG. 13 is a flow diagram of the method of the present invention for fracking and thereafter flushing the annular space to prevent sand-in, using a tool of the third embodiment, namely a flow chart depicting a method of successively configuring the tool as per the successive configurations shown in FIGS. 9A & 9B, 10A & 10B, 11A & 11B, and 12A & 12B.

FIG. 13 is a flow diagram, showing and summarizing the method 800 of the present invention using the third embodiment of the tool 10 as shown in FIGS. 9A & 9B, FIGS. 10A & 10*b*, FIGS. 11A & 11B, FIGS. 12 & 12B.

The first step 801 of method 800, depicted in FIGS. 9A & 9B, involves running tool 10, which possesses hollow bore 16 in the region of dump port 300 and frac port 50, downhole to a desired depth within wellbore 204, typically a lowermost position in wellbore 204. Bypass port 94 will be open, and upper and lower packers 30, 32 will not be set in wellbore 204 'J'-slot 80 will be positioned in the "run in" position shown in FIG. 9B.

The second step 802 of method 800 depicted in FIGS. 10A & 10B comprises pulling slightly upwardly on tool 10 to configure 'j'-slot 80 on tool 10 from a "running" position of step (i) to a "pulling" position, and positioning an uphole and downhole packer member 30, 32 situated on tool 10 on mutually opposite sides of a region along wellbore 204 which is desired to be fracked.

The third step 803 of method 800 depicted in FIGS. 11A & 11B comprises pushing slightly down on an upper portion of tool 10 to cause said 'j' slot 80 to allow movement of a portion of tool 10 wherein jaw members 78 on tool 10 are forced against wellbore 204 and downhole packer member 32 on tool 10 is longitudinally compressed and caused to expand radially outwardly, so as to configure tool 10 in a "set" position. Pushing down on tool 10 will slidably close slidable sleeve 14 over dump ports 300.

The fourth step 804 of method 800, also carried out when the tool is configured as per the configuration shown in FIGS. 11A & 11B, involves injecting pressurized fracking fluid into bore 16 of tool 10. Such causes conical deflector 94 to move to open frac port 50 and close bypass port 94, and further causes the pressurized fluid to pass via a frac port 50 in tool 10 into fissures created in the formation extending radially outwardly from wellbore 204.

The fifth step 805 of method 800, also carried out when tool 10 is configured as per the configuration shown in FIGS. 11A and 11B, entails ceasing supply of said pressurized fracking fluid to bore 16 of tool 10.

The sixth step 806 of method 800, carried out when the tool is configured as per the configuration shown in FIGS. 12A and 12B, comprises pulling upwardly on tool 10 to disengage the jaw members 78 with wellbore 204 and re-configure the 'j' slot 80 into said "pulling" configuration, and simultaneously cause slidable sleeve 14 covering dump port 300 to move so as to uncover dump port 300.

The seventh step 807 of method 800 comprises providing a flushing fluid not containing sand to hollow bore 16 of tool 10 and causing the flushing fluid to be expelled from bore 16 of tool 10 via dump port(s) 300 and thereby flushing the annular space 202 between wellbore 204 and tool 10 with said flushing fluid.

The eight step 808 of method 800 comprises thereafter pulling tool 10 further uphole for further subsequent injection of pressurized fluid containing sand into additional fissures created in formation 200.

The foregoing description of the disclosed embodiments is provided to enable any person skilled in the art to make or use the present invention. The scope of the claims should not be limited by the preferred embodiments set forth in the examples, but should be given the broadest interpretation consistent with the description as a whole. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties.

For a complete definition of the invention and its intended scope, reference is to be made to the summary of the invention and the appended claims read together with and considered with the disclosure and drawings herein.

I claim:

1. A downhole tool for injecting a fluid into a hydrocarbon formation at various spaced intervals along a wellbore and further having capability to flush an annular space between said tool and piping or the wellbore in which the tool is inserted after each interval of injection of said fluid into the hydrocarbon formation, comprising:

(i) an elongate substantially cylindrical member, having a hollow bore and an outer periphery, adapted for insertion in a wellbore;

(ii) an uphole cylindrical, hollow slidable sleeve within said bore;

(iii) a dump port, situated in said outer periphery, configured to direct a stream of fluid radially outwardly from said tool into said annular space, fluid communication of said dump port with said annular space allowed and prevented by slidable movement of said uphole slidable sleeve;

(iv) an uphole packer member, situated on a portion of said periphery downhole of said dump port;

(v) a downhole packer member, situated on a portion of said periphery downhole of said uphole packer member and spaced apart therefrom;

(vi) a frac port in said periphery of said cylindrical member, intermediate said uphole and said downhole packer members;

(vii) a slidably moveable guide member, having radially protruding slip members thereon, said slip members configured to frictionally engage said wellbore casing when said tool is inserted therein, said guide member situated on said tool downhole of said downhole packer member, said guide member further having radially expandable jaw members on an uphole side thereof; and (viii) a T slot subassembly within said tool, situated downhole of said downhole packer member, and having an associated cylindrical hollow mandrel with a slotted profile therein, said T slot subassembly, when downward force is applied to said tool and said guide member frictionally engages said wellbore casing, does not allow further relative downward movement of a lower portion of said downhole packer member relative to said guide member and thus does not allow said jaw members to become actuated, and said 'j' slot subassembly when an upward pulling force is applied to said tool and thereafter a downward force is re-applied to said tool, is then in a 'set' position where said lower portion of said downhole packer member is allowed further downward downhole movement to allow said lower portion of said downhole packer member to be forced against said jaw members so as to expand them radially outwardly to engage said wellbore casing; and wherein slight upward movement of the tool after said tool has been configured in said 'set' position within said wellbore causes said uphole slidable sleeve to uncover said dump port and allow a flushing fluid to be delivered via the bore of said tool to said annular space.

2. The downhole tool as claimed in claim 1, wherein said uphole slidable sleeve is adapted to be slidably moved so as to uncover said dump port when said guide member and said outer periphery possessing said dump port remain stationary at a specific location within said wellbore and a portion of said tool uphole of said dump port and including said uphole slidable sleeve is raised uphole.

3. The downhole tool as claimed in claim 1, wherein said uphole slidable sleeve is adapted to be moved so as to uncover said dump port by a pick-up tool insertable within said bore of said tool.

4. The downhole tool as claimed in claim 1, further having an annular cup seal on said periphery of said tool intermediate said dump port and said downhole packer member, which reduces flow of abrasive pressurized fluid and associated wellbore casing cuttings downhole.

5. The downhole tool as claimed in claim 1, further having an expandable chamber and associated piston member, said chamber adapted to receive fluid under pressure from said bore and cause said associated piston member, when pressurized fluid is supplied to said bore, to compress and outwardly expand said uphole packer member.

6. The downhole tool as claimed in claim 1, further comprising:

a bypass port in said periphery, uphole of the downhole packer, configured when open to provide fluid communication between an exterior of the tool and the hollow bore and permit fluid exterior to the tool and above the downhole packer member to flow into the hollow bore; and a slidable valve member which slidably opens and closes the bypass port; and wherein when said upward pulling force is exerted on said tool said slidable valve member is in an open position thereby keeping open the bypass port, and wherein subsequently actuating said 'j' slot to said 'set' position by subsequent downward force on said tool and/or fluid pressure being further applied to said hollow bore uphole of the slidable valve member, the slidable valve member moves to a closed position thereby closing the bypass port.

7. The downhole tool as claimed in claim 1, wherein the bore, in the region of the frac port, is provided with a deflector to deflect fracking fluid out the frac port.

8. A method for fracturing a hydrocarbon formation which includes flushing an annular space between a fracking tool and a wellbore to prevent sanding-in of the tool prior to repositioning the tool from a first interval to a second, spaced interval along a wellbore, such method comprising the steps of:

(i) running said tool, which possesses a hollow bore in the region between a dump port and a frac port thereon, into said wellbore to a desired depth within said wellbore;

(ii) pulling upwardly on said tool to configure 'j' slot on said tool from a "running" position of step (i) to a "pulling" position and positioning an uphole packer member and a downhole packer member situated on said tool on mutually opposite sides of a region along said wellbore which is desired to be fracked;

(iii) pushing slightly down on an upper portion of said tool to cause said 'j' slot to allow movement of a portion of the tool wherein jaw members on said tool are forced against said wellbore and the downhole packer member on said tool is longitudinally compressed and caused to expand radially outwardly, so as to configure said tool in a "set" position;

(iv) injecting pressurized fracking fluid into said wellbore and into a bore of said tool and causing said pressurized fluid to pass via a frac port in said tool into fissures created in said formation extending radially outwardly from said wellbore;

(v) ceasing supply of said pressurized fracking fluid to said bore of the tool;

(vi) pulling upwardly on the tool so as to move the tool slightly upwardly so as to disengage the jaw members and re-configure the 'j' slot into said "pulling" configuration, and thereby simultaneously causing a slidable sleeve covering said dump port to move so as to uncover said dump port; and (vii) providing a flushing fluid not containing sand to the hollow bore of the tool and causing said flushing fluid to be expelled from the bore of the tool via the dump port and thereby flushing an annular space between the wellbore and the tool with said flushing fluid, and (viii) thereafter pulling the tool further uphole for further subsequent injection of pressurized fluid containing sand into additional fissures created in the formation.

9. The method as claimed in claim 8, further comprising a step of, at the time of performing step (iv) and injecting said pressurized fracking fluid into said bore, causing a piston member in said tool to longitudinally compress the uphole packer member on said tool and cause said uphole packer member to expand radially outwardly.

10. The method as claimed in claim 8, wherein step (iii) further comprises a step of, when pushing slightly down on the upper portion of said tool, closing a bypass port to thereby prevent the otherwise bypass of frac fluid downhole.

11. The method as claimed in claim 8, wherein step (iv) further comprises a step of, when supplying said pressurized fracking fluid to said bore of said tool, closing a bypass port to thereby prevent the otherwise bypass of frac fluid downhole.

12. The method as claimed in claim 8, wherein step (vi) of causing the slidable sleeve covering said dump port to move so as to uncover said dump port comprises a step of inserting a pick up tool within said wellbore and said bore of said tool to move said slidable sleeve uphole to a position uncovering said dump port.

* * * * *